United States Patent [19]

Anzai

[11] 4,156,404

[45] May 29, 1979

[54] ELECTRONIC CLOSED LOOP AIR-FUEL RATIO CONTROL SYSTEM

[75] Inventor: Makoto Anzai, Yokosuka, Japan

[73] Assignee: Nissan Motor Company, Limited, Japan

[21] Appl. No.: 755,496

[22] Filed: Dec. 29, 1976

[30] Foreign Application Priority Data

Dec. 30, 1975 [JP] Japan ..... 50-179721[U]

[51] Int. Cl.[2] ..... F02B 3/00

[52] U.S. Cl. ..... 123/32 EE

[58] Field of Search ..... 123/32 EE, 119 F, 119 C; 60/276, 285

[56] References Cited

U.S. PATENT DOCUMENTS

| | | | |
|---|---|---|---|
| 3,903,853 | 9/1975 | Kizler et al. | 60/285 |
| 4,027,637 | 6/1977 | Aono | 123/32 EE |

*Primary Examiner*—Charles T. Jordan

*Attorney, Agent, or Firm*—Lowe, King, Price & Becker

[57] ABSTRACT

A resistance circuit is connected to a differential signal generator to remove undesirable change of an air-fuel ratio control signal by compensating for temperature-dependent variation of internal resistance of an exhaust gas sensor.

7 Claims, 5 Drawing Figures

ELECTRONIC CLOSED LOOP AIR-FUEL RATIO CONTROL SYSTEM

The present invention relates generally to an electronic closed loop air-fuel ratio control system for use with an internal combustion engine, and particularly to an improvement in such a system for optimally controlling an air-fuel ratio of the air-fuel mixture fed to the engine by removing undesirable change of an air-fuel ratio control signal, which change results from temperature-dependent variation of internal resistance of an exhaust gas sensor.

Various systems have been proposed to supply an optimal air-fuel mixture to an internal combustion engine in accordance with the mode of engine operation, one of which is to utilize the concenpt of an electronic closed loop control system based on a sensed concentration of a component in exhaust gases of the engine.

According to the conventional system, an exhaust gas sensor, such as an oxygen analyzer, is deposited in an exhaust pipe for sensing a component of exhaust gases from an internal combustion engine, generating an electrical signal representative of the sensed component. The oxygen analyzer produces an output such that its voltage is large when the air-fuel ratio is small, and small when large. A differential signal generator is connected to the sensor for generating an electrical signal representative of a differential between the signal from the sensor and a reference signal. The reference signal is previously determined in due consideration of, for example, an optimum ratio of an air-fuel mixture to the engine for maximizing the efficiency of both the engine and an exhaust gas refining means. A so-called proportional-integral (p-i) controller is connected to the differential signal generator, receiving the signal therefrom. A pulse generator is connected to the p-i controller, generating a train of pulses which is fed to an air-fuel ratio regulating means, such as electromagnetic valves, for supplying an air-fuel mixture with an optimum air-fuel ratio to the engine.

In the previously described conventional control system, however, a problem is encountered as follows. That is, the signal from the differential signal generator undesirably changes to result in inviting difficult control of the air-fuel mixture ratio, which change results from temperature-dependent variation of internal resistance of an exhaust gas sensor. As a consequence, it is very difficult to optimally control the air-fuel mixture ratio especially in idling at low ambient temperature.

It is therefore an object of the present invention to provide an improved electronic closed loop control system for removing the above described inherent defect of the conventional system.

Another object of the present invention is to provide an improved electronic closed loop air-fuel ratio control system which includes a resistance circuit connected to a differential signal generator for removing undesirable change of an air-fuel ratio control signal, which change results from temperature-dependent variation of internal resistance of an exhaust gas sensor.

These and other objects, features and many of the attendant advantages of the present invention will be appreciated more readily as the invention becomes better understood by the following detailed description, wherein like parts in each of the several figures are identified by the same reference characters, and wherein:

FIG. 1 schematically illustrates an electronic closed loop air-fuel ratio control system with which the present invention is concerned;

Figure 1:
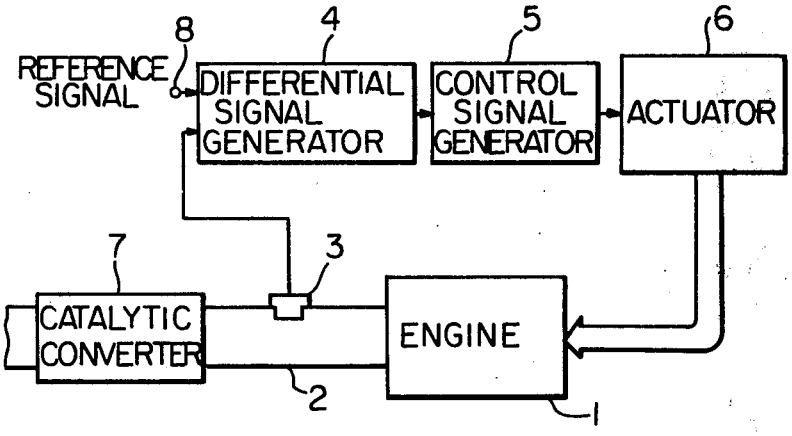
Fig. 1 (PRIOR ART)

Reference is now made to FIG. 1, which illustrates schematically an example of a conventional electronic closed loop control system. An exhaust gas sensor 3 is provided in an exhaust gas pipe 2 extending from an internal combustion engine 1. The exhaust gas sensor 3 senses a concentration of a component (such as, CO, $CO_2$, HC, $NO_x$, and $O_2$, etc.) in exhaust gases to generate a signal representative thereof. A differential signal generator 4 (a differential amplifier or a comparator) is connected to the sensor 3 to receive the signal therefrom. The signal thus received is compared, in the generator 4, with a reference signal which is fed through a terminal 8 to the generator 4 or which is generated in the generator 4 itself. Thus, the generator 4 generates a signal representative of a differential between the signal from the sensor 3 and the reference signal. The signal from the generator 4 is then fed to the next stage, viz., a control signal generator 5 which usually includes a conventional p-i (proportional-integral) controller and a pulse generator. The provision of the p-i controller, as is well known in the art, is to improve the efficiency of the electronic closed loop control system, or in other words, to facilitate a rapid transient response of the system in question. The p-i controller feeds a signal to the pulse generator which generates a pulsating signal in order to control an actuator 6 (for example, an electromagnetic valve). Thus, the air-fuel ratio of the air-fuel mixture fed to the engine 1 is regulated by controlling the amount of fuel and/or air through the actuator 6.

In the above, the magnitude of the reference signal is previously determined in due consideration of optimum air-fuel ratio of the air-fuel mixture supplied to the engine 1 for maximizing the efficiency of a catalytic converter 7 or a reactor (not shown) provided in the exhaust gas pipe 2 downstream of the sensor 3. In this instance, when a so-called three way catalytic converter is employed, the air-fuel ratio is maintained in the vicinity of stoichiometry. This is because the efficiency of the three-way catalytic converter is maximized thereat. A three-way catalytic converter, as is well known, has a characteristic of deoxidizing $NO_x$ and oxidizing both CO and HC at the same time.

In the above described control system, when an $O_2$ sensor is employed as an exhaust gas sensor, the differential signal generator 4 should be provided with one or more p-n-p transistors in its input stage. This is because the output voltage of the $O_2$ sensor is relatively small (0–1 volt), so that an n-p-n transistor does not properly respond to the small voltage.

Figure 2:
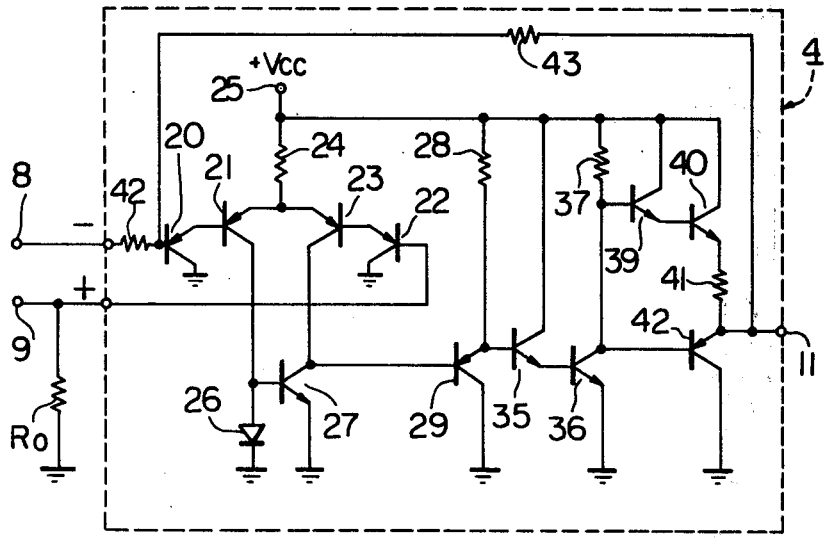
Fig. 2 (PRIOR ART)
FIG. 2 shows a conventional detailed circuit arrangement of an operational amplifier.

Reference is now made to FIG. 2, which illustrates an example of a conventional circuit configuration of the differential signal generator 4 in FIG. 1. Since the circuit of FIG. 2 has been known in the art, detailed description thereof will be omitted in the following. The reference signal is applied to a reversing terminal (no numeral) of the differential signal generator 4 through a terminal 8, and on the other hand, the signal from the sensor 3 is applied to a non-reversing terminal (no numeral) of the same through a terminal 9. A resistor $R_o$ is provided between the terminal 9 and ground. The purpose of the provision of the resistor $R_o$ will be described in detail later. The terminal 8 is connected to the base of a transistor 20 the emitter of which is coupled to the base of a transistor 21 and the collector thereof to ground. The emitter of the transistor 21 is connected through a suitable resistor 24 to a power source (not shown) coupled to a terminal 25 and the collector thereof is connected to ground through a forwardly provided diode 26. Whilst, the terminal 9 is connected to the base of a transistor 22 the collector of which is connected to ground and the emitter thereof is directly connected to the base of a transistor 23. The emitter of the transistor 23 is coupled to the terminal 25 through the resistor 24 and the collector thereof is connected to the collector of a transistor 27 whose emitter is connected to ground. The base of the transistor 27 is connected to a junction between the collector of the transistor 21 and the anode of the diode 26. The transistors 20, 21, 22, and 23 form a differential amplifier, so that these transistors are selected to have substantially equal characteristic with one another. As shown, the collector of the transistor 27 is connected to the base of a transistor 29. The collector of the transistor 29 is connected to ground, and the emitter thereof to both the base of a transistor 35 and the terminal 25 through a resistor 28. The collector of the transistor 35 is connected to the terminal 25 and the emitter thereof directly to the base of a transistor 36. The emitter of the transistor 36 is connected to ground and the collector thereof to the bases of transistors 39, 42, and also connected to the terminal 25 through a resistor 37. The transistors 29, 35 and 36 are provided to amplify the signal current. The collector of the transistor 39 is connected to the terminal 25 and the emitter thereof to the base of a transistor 40. The collector of the transistor 40 is connected to the terminal 25 and the emitter thereof to the emitter of a transistor 42 through a resistor 41. The transistors 39 and 40 form a so-called Darlington amplifier. The collector of the transistor 42 is connected to ground. An output terminal 11 is connected to the emitter of the transistor 42, from which terminal the control signal generator 5 derives the signal indicative of the differential between the two signals supplied to the generator 4 through the terminals 8 and 9.

In such a differential signal generator as shown by reference numeral 4, the amplification degree is determined by the ratio of resistances 43 and 42.

In FIG. 2, the resistance $R_o$ is added to the differential signal generator 4 from two significant points of view. That is, first, when the differential signal generator 4 is accidentally disconnected from the exhaust gas sensor 3, the former responds to the disconnection as though it receives a logic "0." However, if the resistor $R_o$ is not provided, the differential signal generator 4 responds to the disconnection as though it receives a logic "1." This is because the differential signal generator 4 includes p-n-p transistors in its input stage, so that the open ended terminal 9 indicates a signal corresponding to a logic "1." In the latter case, undesired or dangerous power down of the engine is invited in that the actuator 6 supplies a lean air-fuel mixture to the engine 1 in response to the logic "1." Second, since the variation of the internal resistance of the exhaust gas sensor 3 depends upon temperature in such a manner as to increase with temperature fall, in order to exactly detect the output of the exhaust gas sensor 3 at low temperature, the resistance of the resistor $R_o$ should be considerably high.

Figure 3:
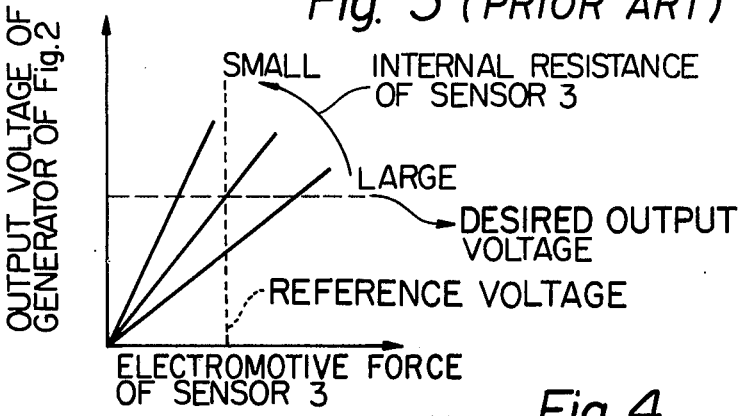
Fig. 3 (PRIOR ART)
FIG. 3 is a graph showing an output characteristic of an operational amplifier of FIG. 2.

In the above, however, the voltage drop across the resistor $R_o$ due to a bias current of the differential signal generator 4 is not negligible because of the large resistance of the resistor $R_o$. As a result, the output voltage of the generator 4 as a function of the output voltage of the sensor 3 undesirably changes for different internal resistances of the sensor 3 as shown in FIG. 3. This means that the control of the air-fuel mixture ratio can not be precisely carried out.

The present invention contemplates to remove the above mentioned inherent defect of the prior art by compensating for the voltage drop due to the bias current, thereby to present an improved air-fuel ratio control system which optimally controls an air-fuel ratio in spite of the variation of the internal resistance of the sensor 3.

Figure 4:
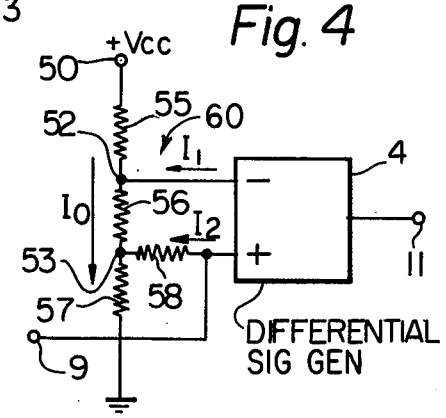
FIG. 4 shows a circuit arrangement of a differential signal generator embodying the present invention.

Reference is now made to FIG. 4, which illustrates a preferred embodiment of the present invention. The circuitry shown in FIG. 4 includes a resistor network circuit which includes a voltage divider 60, and a differential signal generator 4. The differential signal generator 4 has the same construction as shown in FIG. 2. The voltage divider 60 consists of first, second and third resistors 55, 56 and 57. These three resistors 55, 56 and 57 are connected in series while the whole voltage divider 60 is interposed between a d.c. power supply terminal 50 and ground. The terminal 50 is connected to a suitable d.c. power supply the potential of which is assumed to be $V_{cc}$. A junction 52 between the resistors 55 and 56 is connected to the inverting terminal of the amplifier 4, applying a potential appearing thereat to the reversing terminal as the reference signal. The junction 52 receives a bias current flow $I_1$ from the inverting terminal of the amplifier 4. A junction 53 between the resistors 56 and 57 is connected through a resistor 58 to the non-inverting terminal of the amplifier 4 to which the sensor 3 (FIG. 1) is also connected through the terminal 9. The junction 53 receives a bias current flow $I_2$ from the non-inverting terminal through the reistor 58. Since each of the resistances of the resistors 55, 56, and 57 is relatively small, voltage drop thereacross due to the bias currents $I_1$ is negligible. On the contrary, the current $I_o$ from the d.c. power source is so large that the voltage drop across each of the resistors 55, 56, and 57 is considerably large, so that the voltage drop thereacross due to the current $I_2$ is not negligible notwithstanding a small current of the bias current $I_2$. Whilst, the resistance of the resistor 58 is relatively large, the voltage drop thereacross is not negligible.

It is therefore understood that, if the voltage drop across the resistor 56 is equal to or approximately equal to the voltage drop across the resistor 58, the output of the difference signal generator 4 is not affected by the bias current $I_1$ and/or $I_2$.

Furthermore, if the voltage drop across the resistor 56 is little higher than that across the resistor 58, the differential signal generator 4 responds to the disconnection of the same from the sensor 3, generating a signal which increases the engine power. This is because, when the disconnection occurs, the voltage applied to the non-inverting terminal of the amplifier 4 is always lower than the reference voltage at the junction 52.

Still furthermore, if the voltage drop across the resistor 56 is equal to or approximately equal to that across the resistor 58, the input impedance of the differential signal generator 4 is apparently very large when the voltage of the signal from the sensor 3 is in the vicinity of the reference one. This is because, under such a condition, the differential signal generator 4 receives a neglibile current from the sensor 3.

Figure 5:
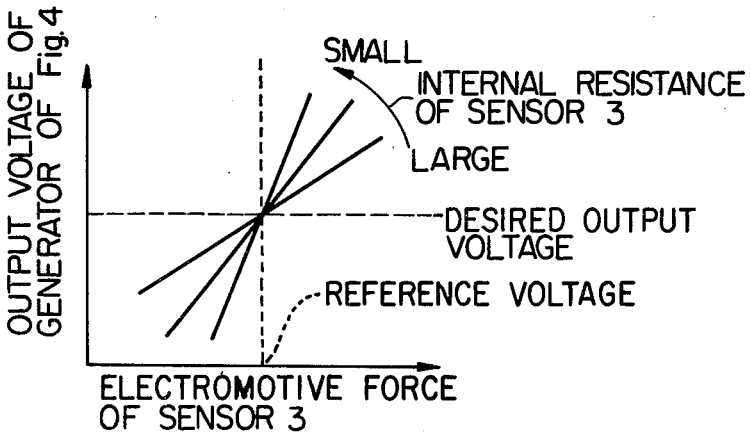
FIG. 5 is a graph showing an output characteristic of an operational amplifier employed in the preferred embodiment of the present invention.

In FIG. 5, there is shown an output characteristic of the differential signal generator of FIG. 5. Since no or negligible current flows into or from the gas sensor 3 when the electromotive force of the gas sensor 3 corresponds to the reference voltage obtained at the first junction 52, the influence of the voltage drop across the resistors 58 and 37 can be negligible irrespectively of the variation of the internal resistance of the gas sensor 3. This means that although the actual input impedance of the circuit arrangement is, in fact, small, the quasi input impedance of the same is extremely large. Therefore, when the electromotive force of the gas sensor 3 corresponds to the reference voltage, the output voltage of the difference signal generator 4 assumes a predetermined voltage irrespectively of the variation of the internal resistance of the gas sensor 3 as shown in FIG. 5.

What is claimed is:

1. An electronic closed loop air-fuel ratio control system for supplying an optimum air-fuel mixture to an internal combustion engine, said system comprising:

an air-fuel mixture supply assembly;

an exhaust gas sensor disposed in an exhaust passage of said engine, said sensor generating an electrical signal indicative of the concentration of a component contained in the exhaust gases, said sensor having a temperature-dependent, internal resistance characteristic;

means for compensating for the temperature-dependent, internal resistance characteristic of said sensor to optimally control the air-fuel ratio of the air-fuel mixture fed to the engine, including (a) a voltage divider having first and second junctions for obtaining first and second predetermined voltages, said voltage divider including first, second and third resistors connected in series, said voltage divider being supplied with first and second predetermined potentials, said first junction connecting said first and second resistors, said second junction connecting said second and third resistors;

(b) an operational amplifier having first and second inputs and an output, said first input being connected to said first junction for receiving said first predetermined voltage as a reference signal, said second input being connected to said gas sensor for receiving said signal derived from said gas sensor; and (c) a resistor interposed between said second junction of said voltage divider and said second input of said operational amplifier;

a control signal generator connected to said output of said operational amplifier for producing a control signal in response to the output signal derived from said operational amplifier; and an actuator operatively connected to said air-fuel mixture supply assembly, said actuator being responsive to said control signal.

2. An electrical closed loop air-fuel ratio control system as claimed in claim 1, wherein the input stage of said operational amplifier comprises p-n-p type transistors.

3. An electronic closed loop air-fuel ratio control system as claimed in claim 1, wherein said operational amplifier is so arranged that it functions as a comparator.

4. An electronic closed loop air-fuel ratio control system as claimed in claim 1, wherein said operational amplifier is so arranged that it functions as a differential amplifier.

5. An electronic closed loop air-fuel ratio control system as claimed in claim 1, wherein the resistances of said second resistor and said resistor connected to said second input of said differential amplifier are so selected that the voltage drops across thereof are equal to each other.

6. An electronic closed loop air-fuel ratio control system as claimed in claim 1, wherein the resistances of said second resistor and said resistor connected to said second input of said differential amplifier are so selected that the voltage drop across said second resistor is slightly higher than that of said resistor connected to said second input of said differential amplifier.

7. An electronic closed loop air-fuel ratio control system as claimed in claim 1, wherein the resistance of said resistor interposed between said second junction of said voltage divider and said second input of said operational amplifier is larger than those of said first, second and third resistors.

* * * * *